US011350683B2

(12) United States Patent
Brierley et al.

(10) Patent No.: US 11,350,683 B2
(45) Date of Patent: Jun. 7, 2022

(54) DORSAL PROTECTION FOR GLOVES

(71) Applicant: Superior Glove Works Limited, Acton (CA)

(72) Inventors: William Joseph Brierley, Freelton (CA); Sachithrajith Prasad Tennakoon, Burlington (CA)

(73) Assignee: SUPERIOR GLOVE WORKS LIMITED, Ontario (CA)

( * ) Notice: Subject to any disclaimer, the term of this patent is extended or adjusted under 35 U.S.C. 154(b) by 132 days.

(21) Appl. No.: 16/778,728

(22) Filed: Jan. 31, 2020

(65) Prior Publication Data

US 2021/0235795 A1 Aug. 5, 2021

(51) Int. Cl.
*A41D 19/015* (2006.01)
*A41D 19/00* (2006.01)

(52) U.S. Cl.
CPC .... *A41D 19/01523* (2013.01); *A41D 19/0058* (2013.01); *A41D 19/015* (2013.01); *A41D 19/01517* (2013.01)

(58) Field of Classification Search
CPC ..... A41D 19/01523; A41D 19/01505; A41D 19/01588; A41D 19/01547
See application file for complete search history.

(56) References Cited

U.S. PATENT DOCUMENTS 3,882,548 A * 5/1975 Shinagawa ..... A41D 19/01523 2/161.1
4,094,014 A * 6/1978 Schroeder ..... A41D 19/01505 D29/117.1
4,605,582 A * 8/1986 Sias ..... A61G 7/05707 428/120
4,673,605 A * 6/1987 Sias ..... A61G 7/05707 428/120
D294,212 S * 2/1988 Sias ..... D6/587
D360,059 S * 7/1995 Kalvestran ..... D29/113
5,435,007 A * 7/1995 Kalvestran ..... A41D 13/088 2/161.1

(Continued)

FOREIGN PATENT DOCUMENTS

CN 202760233 U * 3/2013
CN 202760233 U 3/2013

(Continued)

*Primary Examiner* — Clinton T Ostrup
*Assistant Examiner* — Akwokwo Olabisi Redhead
(74) *Attorney, Agent, or Firm* — Tarolli, Sundheim, Covell & Tummino LLP

(57) ABSTRACT

An impact damper for a glove comprises a solid convex element formed from a resilient material. The convex element has a zenith cavity formed at its zenith. Upon an impact on the convex element, the zenith cavity enables resilient outward deformation of the convex element, and the resilient outward deformation dissipates energy from the impact. The impact damper may further comprise an outwardly deformable wall formed from a resilient material, with the wall circumferentially surrounding and spaced from the convex element. Upon an impact on the convex element, the convex element engages the wall as the convex element deforms, and resilient outward deformation of the wall under urging from the deforming convex element further dissipates the energy from the impact.

11 Claims, 10 Drawing Sheets

(56) References Cited

U.S. PATENT DOCUMENTS 6,035,444 A * 3/2000 McGrew ..... A41F 1/06 2/161.8
7,320,145 B2 * 1/2008 Hochmuth ..... A63B 71/148 2/163
D650,532 S * 12/2011 Choi ..... D2/619
8,490,217 B2 * 7/2013 Safford ..... A41D 19/01529 2/163
D745,746 S * 12/2015 Hughes ..... D29/117.1
D752,296 S * 3/2016 Urbelis ..... D29/117.2
D809,714 S * 2/2018 Lim ..... A41D 19/01505 D29/117.1
D844,254 S * 3/2019 Lim ..... A41D 19/0024 D29/117.1
D850,756 S * 6/2019 Plant ..... D2/619
10,506,836 B2 * 12/2019 Takagi ..... A41D 13/0156
D932,132 S * 10/2021 Carr ..... D2/619
2006/0048259 A1 * 3/2006 Keppler ..... A41D 19/01588 2/21
2007/0245453 A1 * 10/2007 Dolenak ..... A41D 19/01529 2/161.6
2010/0083420 A1 * 4/2010 Bouckaert ..... A41D 19/01547 2/163
2011/0088139 A1 * 4/2011 Travell ..... A41D 19/01588 2/163
2011/0107498 A1 * 5/2011 Chang ..... A41D 19/01588 2/163
2014/0033392 A1 * 2/2014 Bulan ..... A41D 19/01547 2/16
2016/0037861 A1 * 2/2016 Diepenbrock ..... A43B 17/03 36/43
2019/0328062 A1 * 10/2019 Kamphuis ..... A41D 19/01588
2019/0357612 A1 * 11/2019 Safford ..... A41D 19/01505
2019/0387818 A1 * 12/2019 Kishihara ..... A41D 19/01523
2021/0085001 A1 * 3/2021 Gong ..... A41H 42/00

FOREIGN PATENT DOCUMENTS

KR 20160042494 A 4/2016
WO WO-2020082055 A1 * 4/2020 ..... A41D 19/015

* cited by examiner

DORSAL PROTECTION FOR GLOVES

TECHNICAL FIELD

The present invention relates to gloves, and more particularly to gloves having impact protection for the dorsal side of a user's hand.

BACKGROUND

In certain activities, it is desirable to use gloves that provide impact protection for the dorsal side of the hand. It is known to provide gloves that include a resilient material such as rubber on the dorsal side to provide some cushioning.

Some examples of gloves that provide protection on the dorsal side are disclosed in CN202760233U and KR10-1681731.

There remains a need to provide improved impact protection for the dorsal sides of gloves, particularly for the vulnerable knuckles.

SUMMARY

In one aspect, an impact damper for a glove comprises a solid convex element formed from a resilient material. The convex element has a zenith cavity formed at its zenith. Upon an impact on the convex element, the zenith cavity enables resilient outward deformation of the convex element, and the resilient outward deformation dissipates energy from the impact.

In some embodiments, the impact damper may further comprise an outwardly deformable wall formed from a resilient material, with the wall circumferentially surrounding and spaced from the convex element. Upon an impact on the convex element, the convex element engages the wall as the convex element deforms, and resilient outward deformation of the wall under urging from the deforming convex element further dissipates the energy from the impact. In one particular embodiment, the wall is divided into circumferentially spaced sectors. In another particular embodiment, the wall is continuous.

A finger protector formed from resilient material may comprise a longitudinally extending flexible digitiform base carrying a plurality of instances of the impact damper arranged in spaced-apart relation to one another and adapted to be aligned in registration with respective knuckles on a finger of a correspondingly sized human hand. The finger protector may be monolithic. The finger protector may further comprise respective series of spaced-apart protrusions extending between the impact dampers. The base may extend beyond a distal one of the impact dampers and may include a terminal projection.

A metacarpal protector formed from resilient material may comprise a flexible metacarpal linkage and a plurality of flexible metacarpal prongs extending from the metacarpal linkage in side-by-side spaced apart maniform relation, with each metacarpal prong carrying at least one instance of the impact damper. The metacarpal protector may be monolithic. Each metacarpal prong may extend beyond the respective impact damper and may include a terminal projection.

A glove may have a plurality of instances of the impact damper affixed on a dorsal side of the glove. The instances of the impact damper may be carried by a metacarpal protector and a plurality of finger protectors affixed to the glove. The instances of the impact damper may be carried by one or more of a metacarpal protector, a plurality of finger protectors and a thumb protector, all affixed to the glove.

BRIEF DESCRIPTION OF THE DRAWINGS

These and other features of the invention will become more apparent from the following description in which reference is made to the appended drawings wherein.

DETAILED DESCRIPTION

Figure 1:
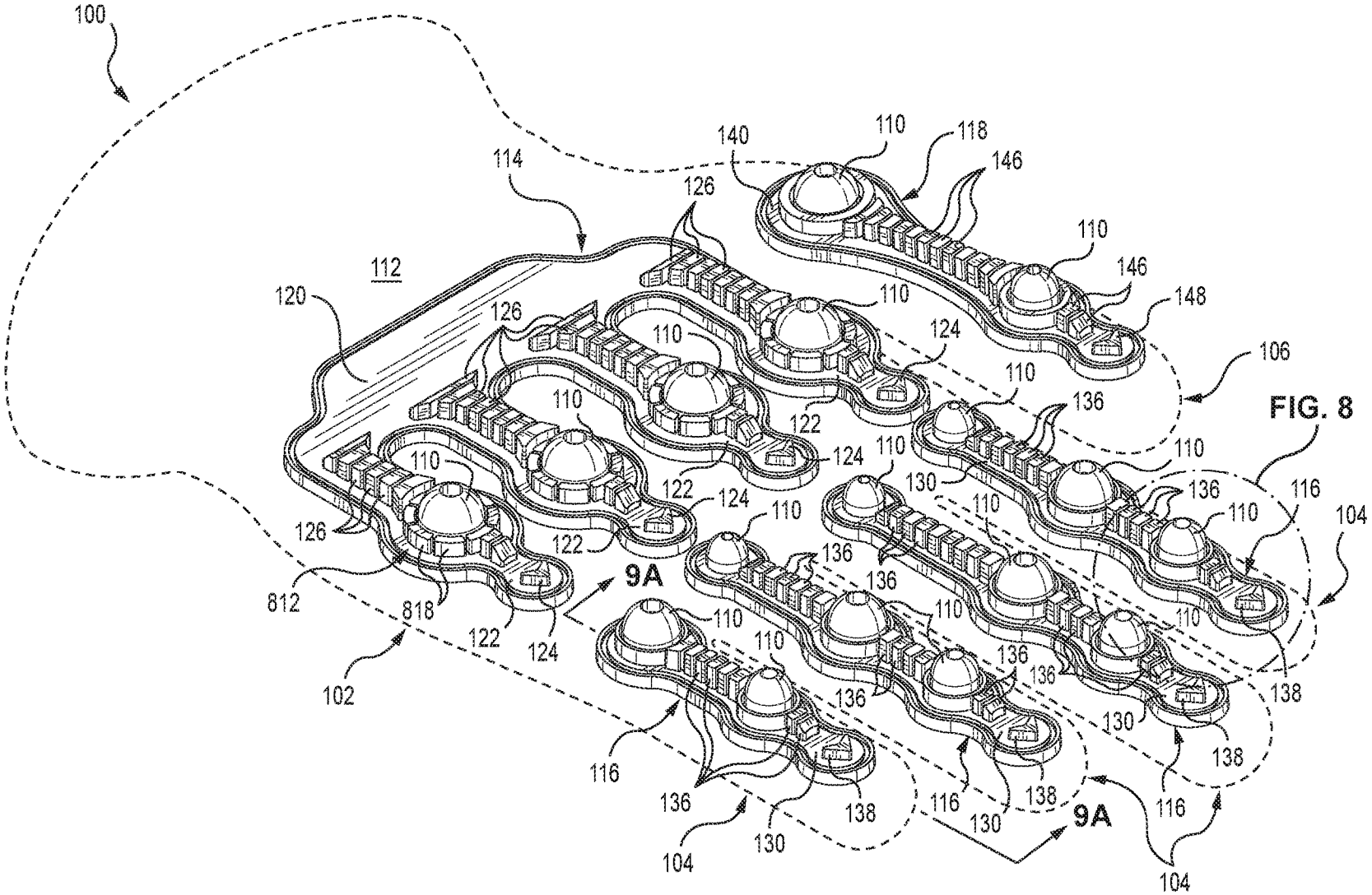
FIG. 1 is a dorsal perspective view of a first illustrative glove according to an aspect of the present disclosure.
Figure 2:
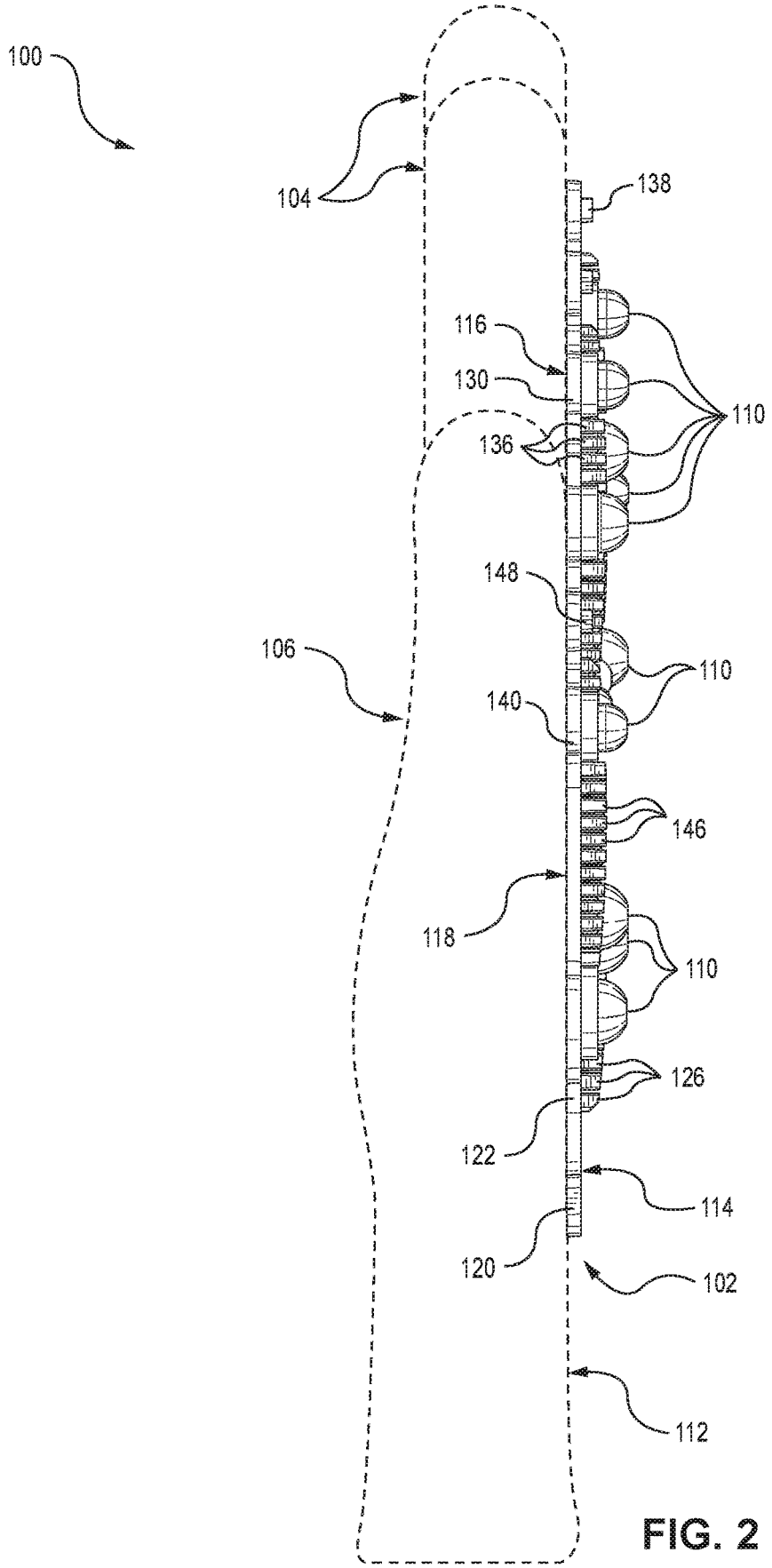
FIG. 2 is a medial side elevation view of the glove of FIG. 1.
Figure 3:
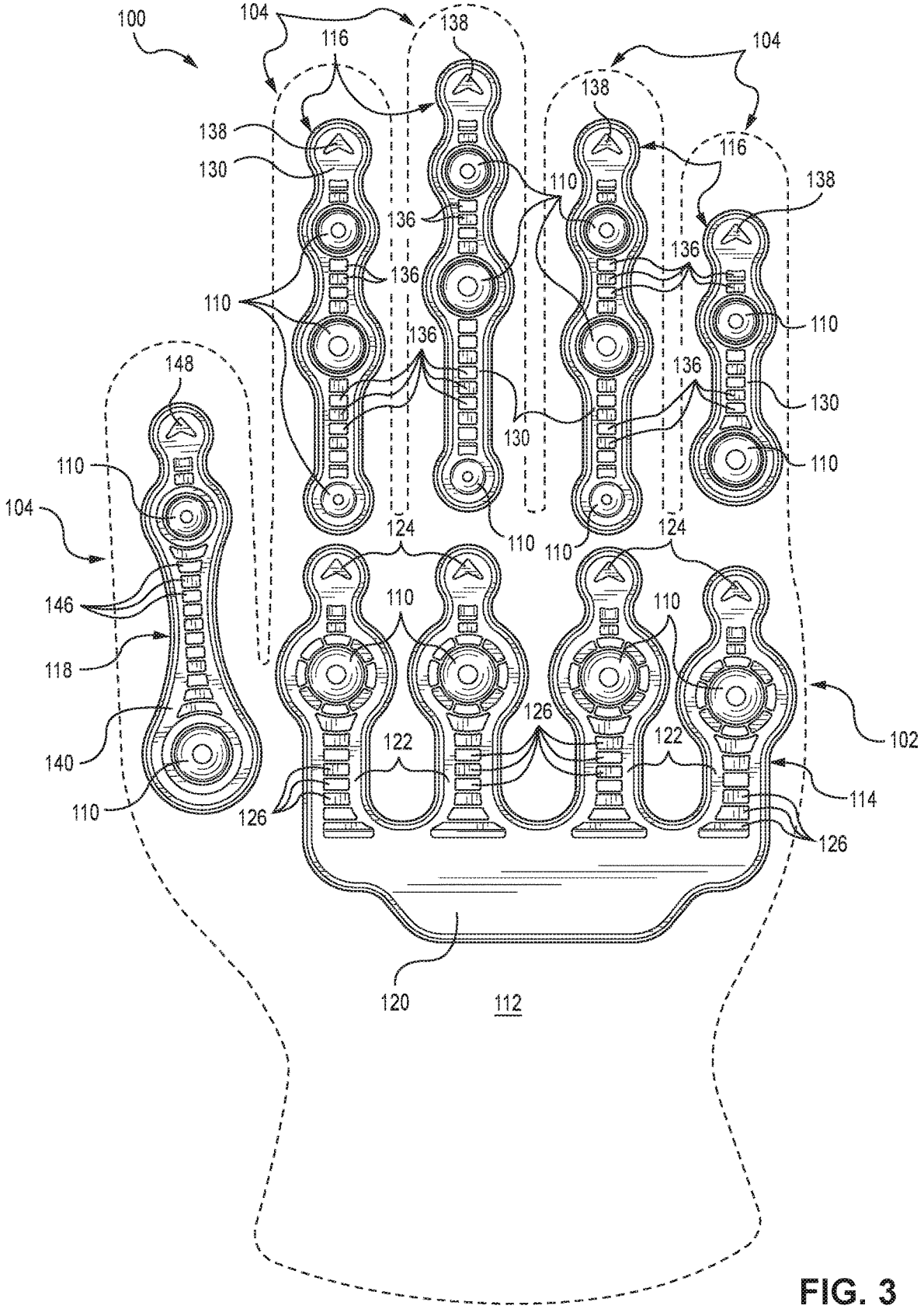
FIG. 3 is a dorsal plan view of the glove of FIG. 1.
Figure 4:
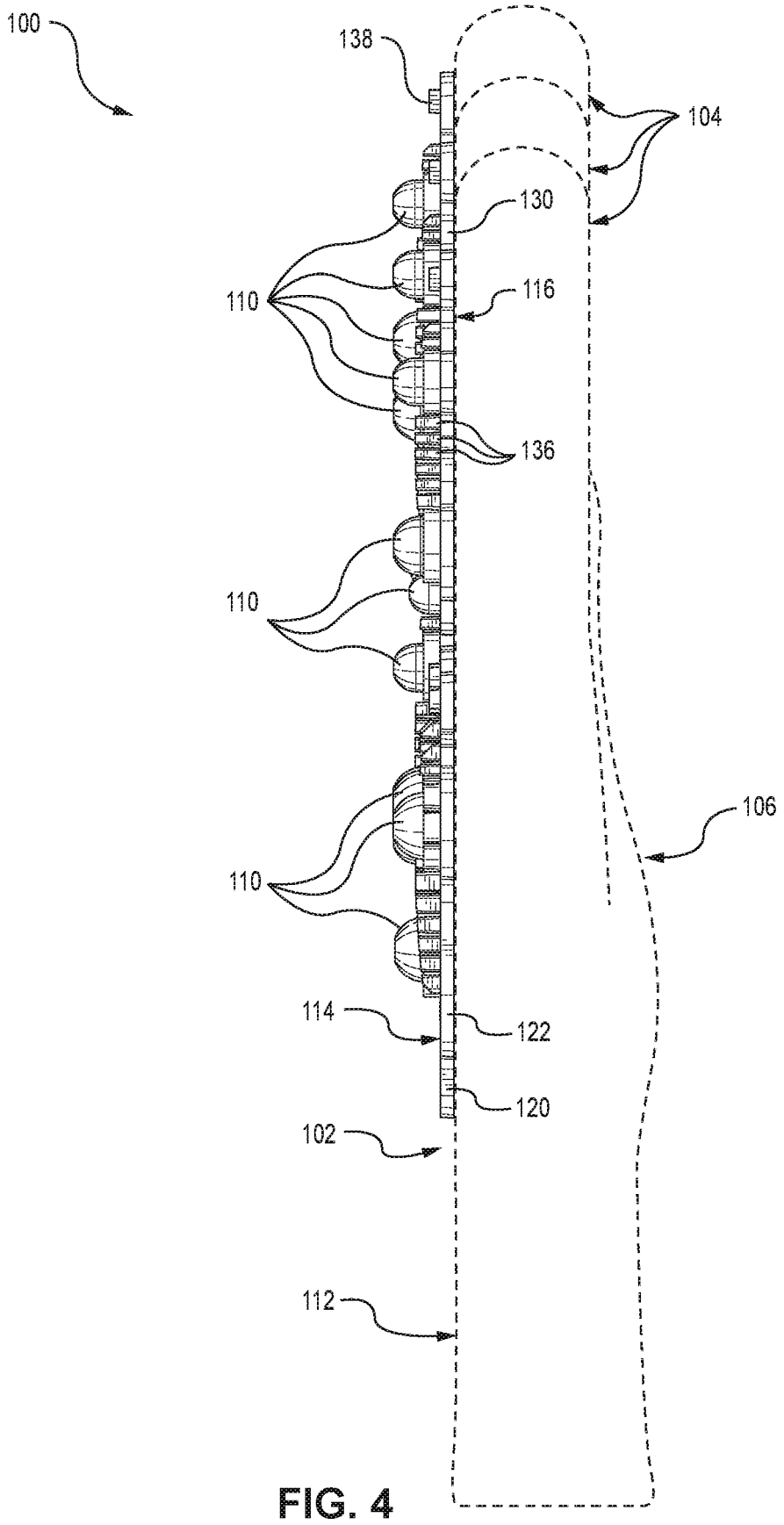
FIG. 4 is a lateral side elevation view of the glove of FIG. 1.
Figure 5:
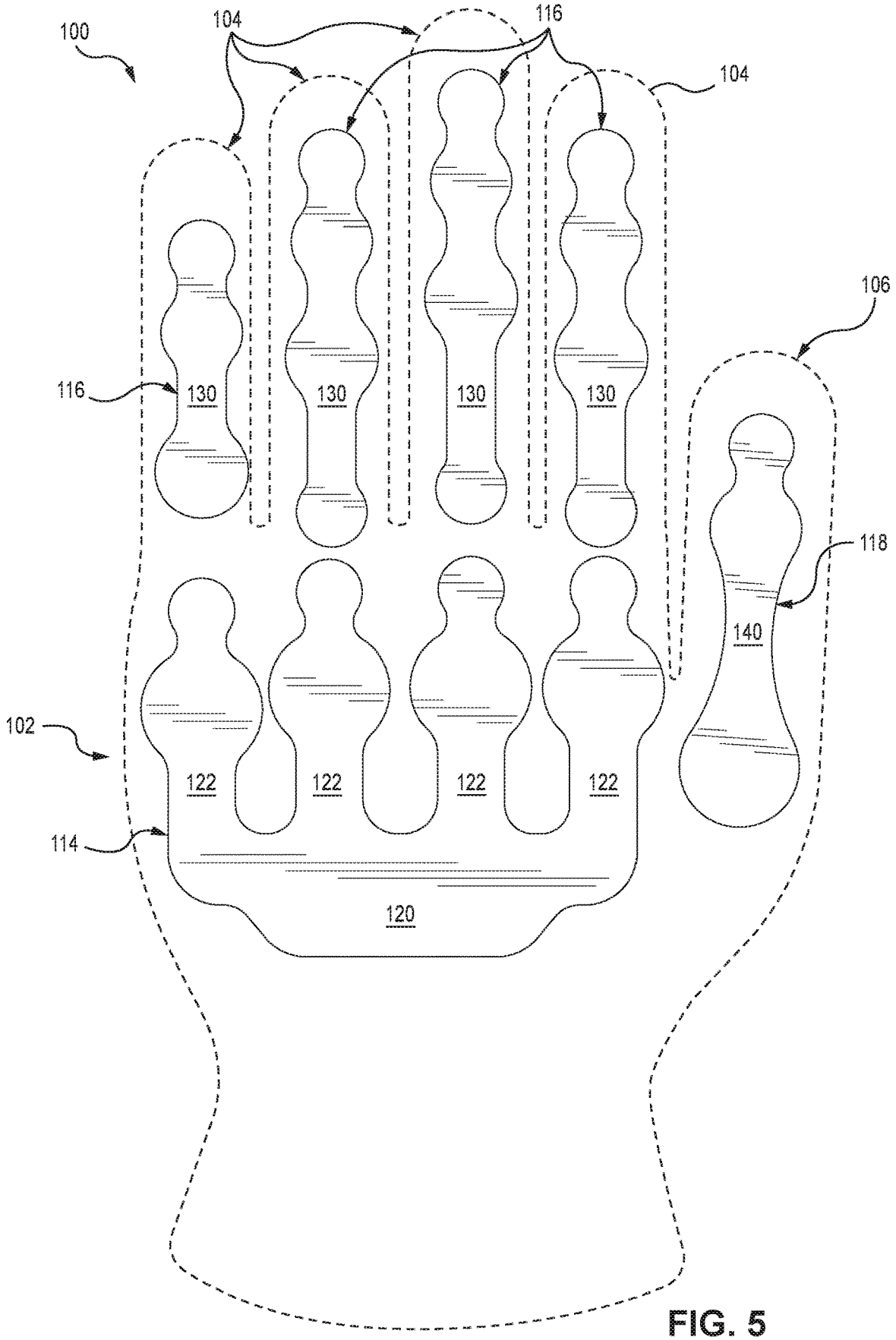
FIG. 5 is a transparent palmar plan view of the glove of FIG. 1.
Figure 6:
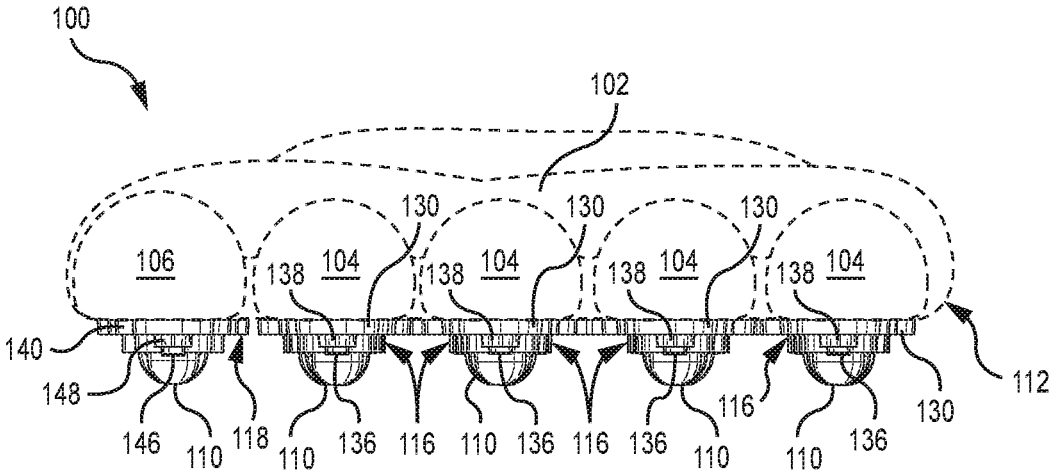
FIG. 6 is a distal side elevation view of the glove of FIG. 1.
Figure 7:
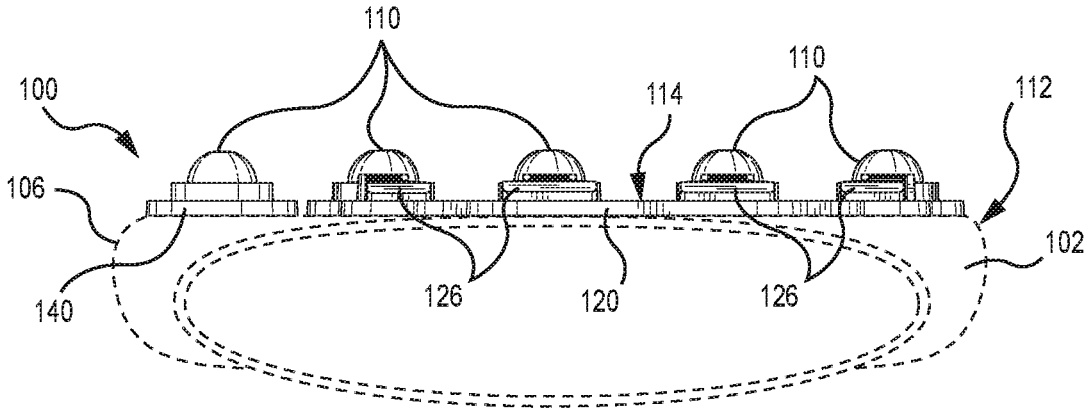
FIG. 7 is a proximal side elevation view of the glove of FIG. 1.

Reference is now made to FIGS. 1 through 7, which show a glove 100. The glove 100 comprises a main body portion 102, four finger portions 104 and a thumb portion 106. The glove may be of any suitable construction, and may be made from any suitable materials or combinations of materials. For example, the glove 100 may be of one or more materials that provide any one or more of cut resistance, puncture resistance, enhanced grip, cushioning and/or temperature resistance. The precise manner of construction and the materials used in the glove are not of particular relevance; the glove 100 is therefore shown in dashed lines. The glove 100 also includes ornamental features as would be understood to those skilled in the art.

The glove 100 has a plurality of impact dampers 110 affixed on a dorsal side 112 of the glove. In the illustrated embodiment, the impact dampers 110 are carried by a metacarpal protector 114, a plurality of finger protectors 116 and a thumb protector 118. The metacarpal protector 114, finger protectors 116 and thumb protector 118 are affixed to the glove 100 on the dorsal side 112 thereof, and may be affixed by any suitable means, including adhesive, stitching and injection molding, for example. As can be seen, the metacarpal protector 114 is affixed to the main body portion 102, the finger protectors 116 are affixed to the four finger portions 104 and the thumb protector 118 is affixed to the thumb portion 106. Thus, the glove 100 has a plurality of the impact dampers 110 affixed on the dorsal side 112 of the glove 100.

The metacarpal protector 114 is flexible, and is preferably formed from a resilient material. Examples of suitable resilient material include, but are not limited to, polyvinyl chloride and thermoplastic rubber. The metacarpal protector 114 comprises a base formed by a flexible metacarpal linkage 120 and a plurality of flexible metacarpal prongs 122 extending from the metacarpal linkage 120 in side-by-side spaced-apart maniform relation. Thus, when the glove 100 is suitably sized and is worn by a human person, the metacarpal prongs 122 will be substantially in registration with the metacarpal bones of the human person's hand. Each metacarpal prong 122 carries an impact damper 110. In the illustrated embodiment, each metacarpal prong 122 extends beyond the respective impact damper 110 and includes a chevron-shaped terminal projection 124. A series of spaced-apart protrusions 126 extend from the metacarpal prongs 122 between the impact dampers 110 and the metacarpal linkage 120; the protrusions provide additional impact protection while the spacing permits flexibility.

Figure 8:
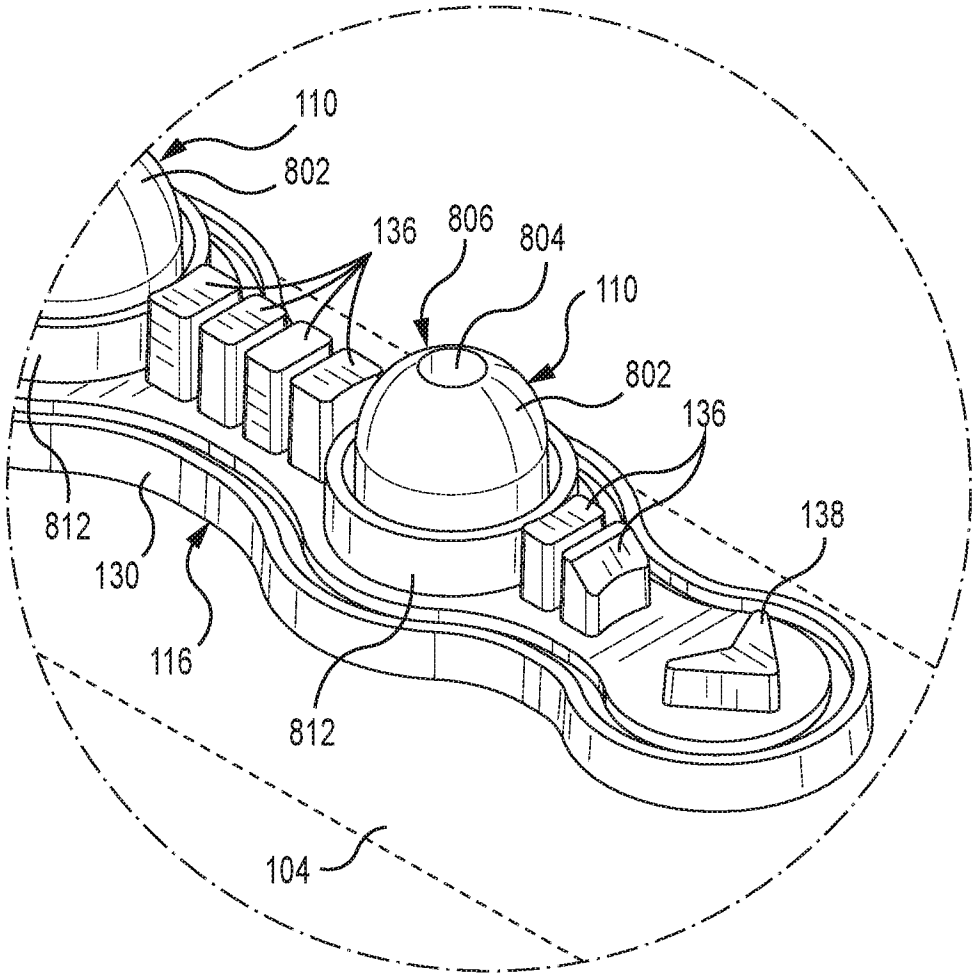
FIG. 8 is a detail view showing a portion of a finger protector including an impact damper of the glove of FIG. 1.
Figure 9A:
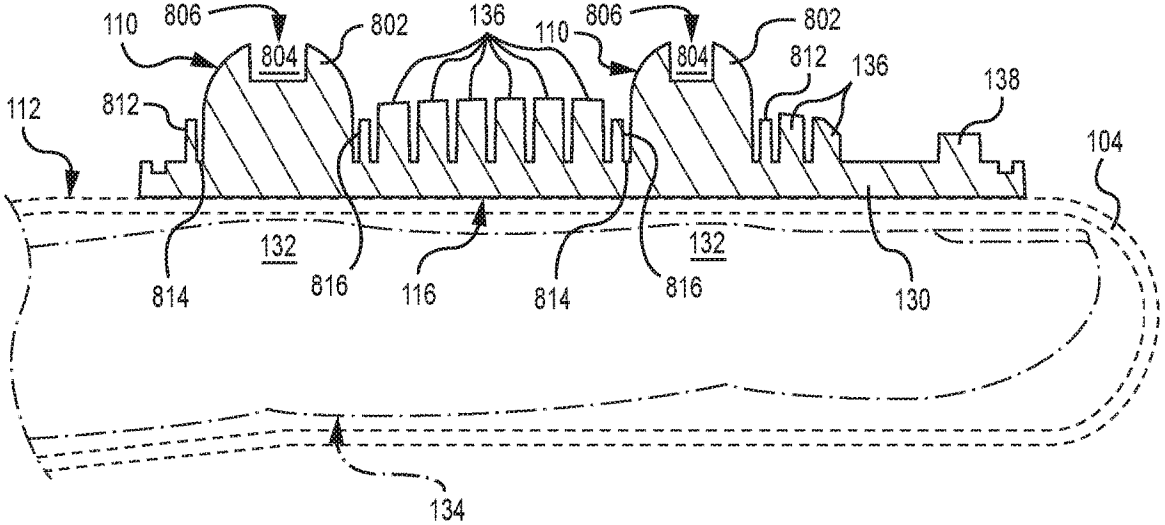
FIG. 9A is a cross-sectional view taken along line 9-9 in FIG. 1.
Figure 9B:
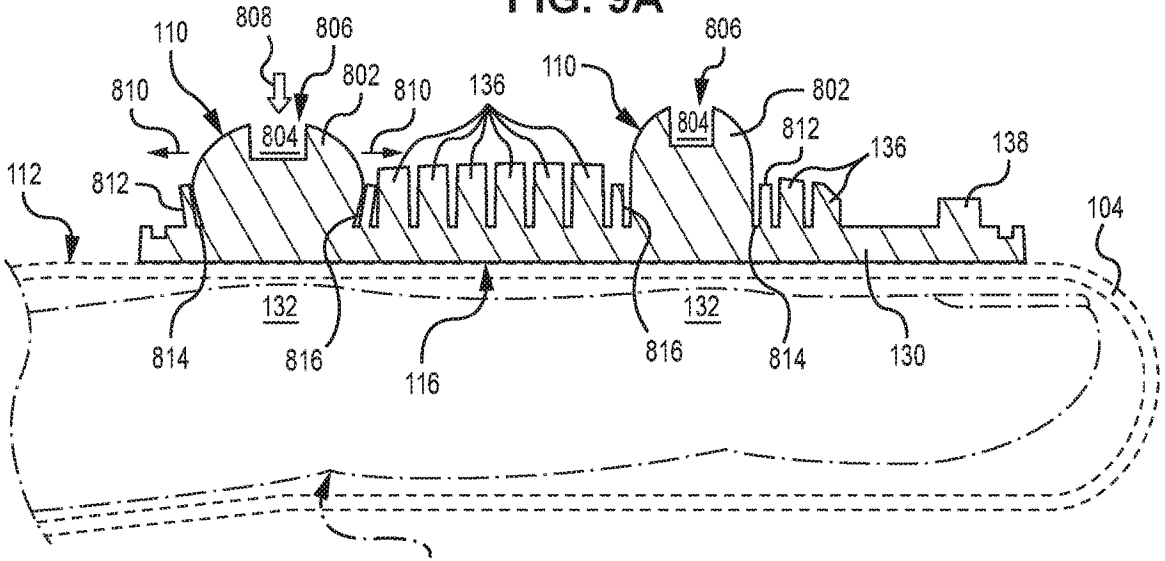
FIG. 9B is a cross-sectional view similar to that in FIG. 9, showing deformation thereof.

The finger protectors 116 are flexible and are preferably formed from a resilient material, and each comprise a longitudinally extending digitiform base 130 carrying a plurality of impact dampers 110 arranged in spaced-apart relation to one another. Examples of suitable resilient material include, but are not limited to, polyvinyl chloride and thermoplastic rubber. As can be seen in FIGS. 9A and 9B, the impact dampers 110 are arranged so that when a suitably sized glove 100 is worn a correspondingly sized human hand, the impact dampers 110 will be aligned in registration with respective knuckles 132 on a finger 134 of that hand. As best seen in FIG. 8, the finger protectors 116 further comprise respective series of spaced-apart protrusions 136 from the base 130 extending between the impact dampers 110. The protrusions 136 provide impact protection between the impact dampers 110 while the spaced-apart arrangement allows the fingers to bend. In the illustrated embodiment, the base 130 extends beyond the distal impact damper 110 and includes a chevron-shaped terminal projection 138, which provides impact protection for the fingertip.

The illustrated thumb protector 118 is of similar construction to the finger protectors, and comprises a longitudinally extending flexible digitiform base 140 carrying two spaced-apart impact dampers 110 with a series of spaced-apart protrusions 146 from the base 140 extending between the impact dampers 110. The base 140 extends beyond the distal impact damper 110 and includes a chevron-shaped terminal projection 148 to protect the tip of the thumb from impact. Analogously to the finger protectors 116, the impact dampers 110 on the thumb protector 118 are arranged so that when a suitably sized glove 100 is worn a correspondingly sized human hand, the impact dampers 110 will be aligned in registration with respective knuckles the thumb of that hand. The thumb protector 118 is preferably formed from a resilient material, examples of which include, but are not limited to, polyvinyl chloride and thermoplastic rubber.

With reference now to FIGS. 8, 9A and 9B, an illustrative impact damper 110 will now be described in greater detail.

The impact damper 110 comprises a solid, monolithic convex element 802 formed from a resilient material. In the illustrated embodiment, the convex element is generally shaped as a dome-topped cylinder, although other convex shapes are also contemplated, for example polygonal convex shapes such as a partial polyhedron, e.g. a partial geodesic dome. The convex element 802 is truncated and recessed, and has a zenith cavity 804 formed at its zenith 806. Upon an impact on the convex element 802, as shown by arrow 808 in FIG. 9B, the zenith cavity 804 enables resilient outward deformation, shown by arrow 810 in FIG. 9B, of convex element 802. This resilient outward deformation dissipates energy from the impact 808.

In a preferred embodiment, the impact damper 110 further comprises an outwardly deformable wall 812 formed from a resilient material. The wall 812 circumferentially surrounds and is spaced from the convex element 802 by a spacer 814. The wall 812 and spacer 814 are formed monolithically with the convex element 802. Upon an impact 810 on the convex element 802 adjacent the zenith 806 thereof, the convex element 802 engages an inner surface 816 of the wall 812 as the convex element 802 undergoes outward elastic deformation, and resilient outward deformation of the wall 812 under urging from the deforming convex element 802 further dissipates the energy from the impact 810. In the finger protectors 116 and the thumb protector 118, the wall 812 is continuous. In the metacarpal protector 114, the wall 812 is divided into circumferentially spaced sectors 818 (see FIG. 1).

After the impact 810, the impact damper 110, including the convex element 802 and the wall 812, resiliently returns to its original configuration.

Preferably, each of the metacarpal protector 114, the finger protectors 116 and the thumb protector 118 is of monolithic construction, including the respective base 120/122, 130, 140, convex element(s) 802, wall(s) 812, protrusions 126, 136, 146 and projections 124, 138, 148.

It is contemplated that a glove according to the present disclosure need not have all of the metacarpal protector 114, the finger protectors 116 and the thumb protector 118; one or more of these components may be omitted depending on the application in which the glove is intended to be used. In some embodiments, some finger portions of the glove may have finger protectors and other portions may not. Other configurations are also contemplated, for example impact dampers as described herein may be discretely affixed to the glove in isolation from a metacarpal protector, finger protector or thumb protector.

Figure 10:
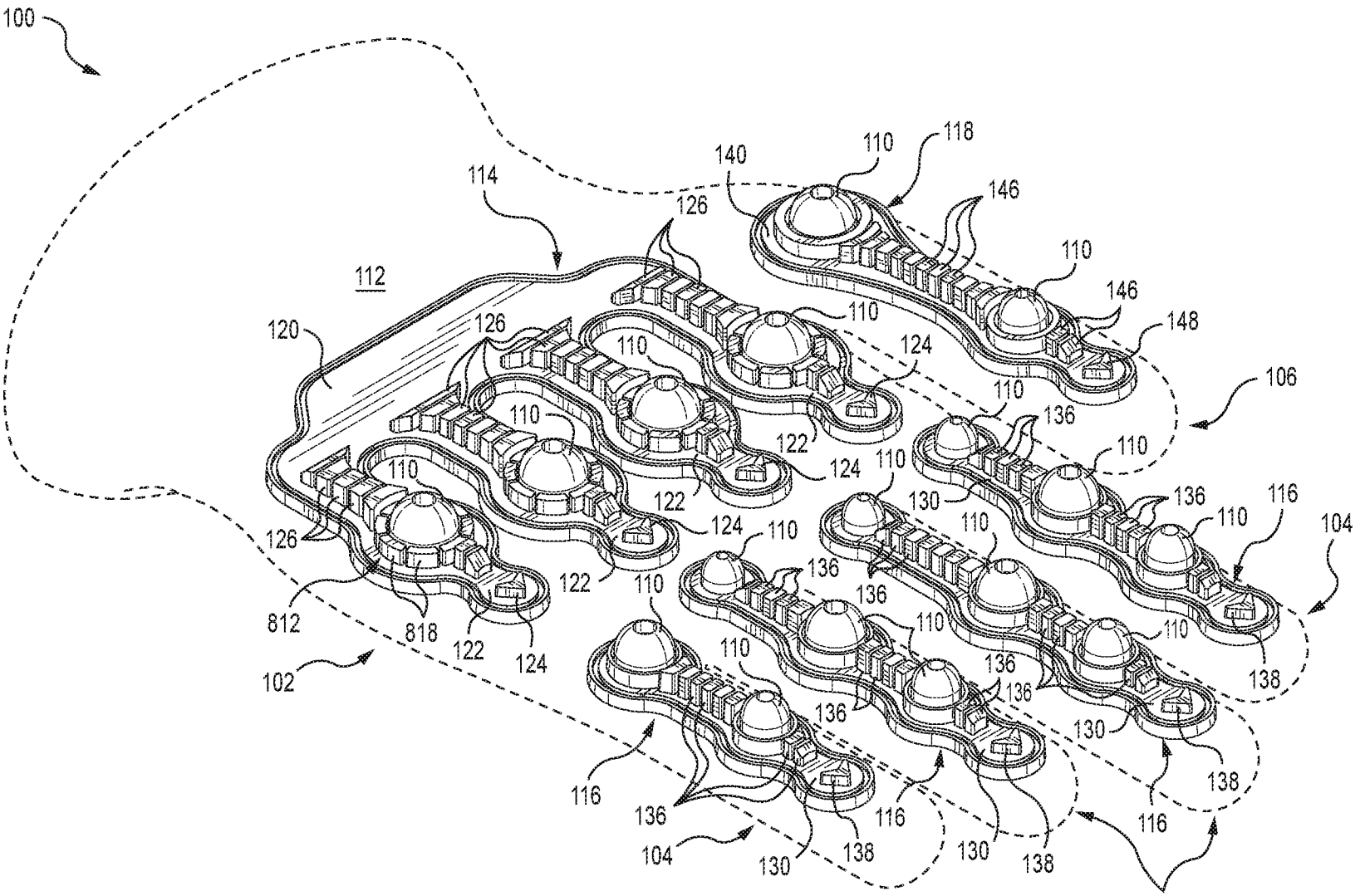
FIG. 10 is a dorsal perspective view of a second illustrative glove according to an aspect of the present disclosure.
Figure 11:
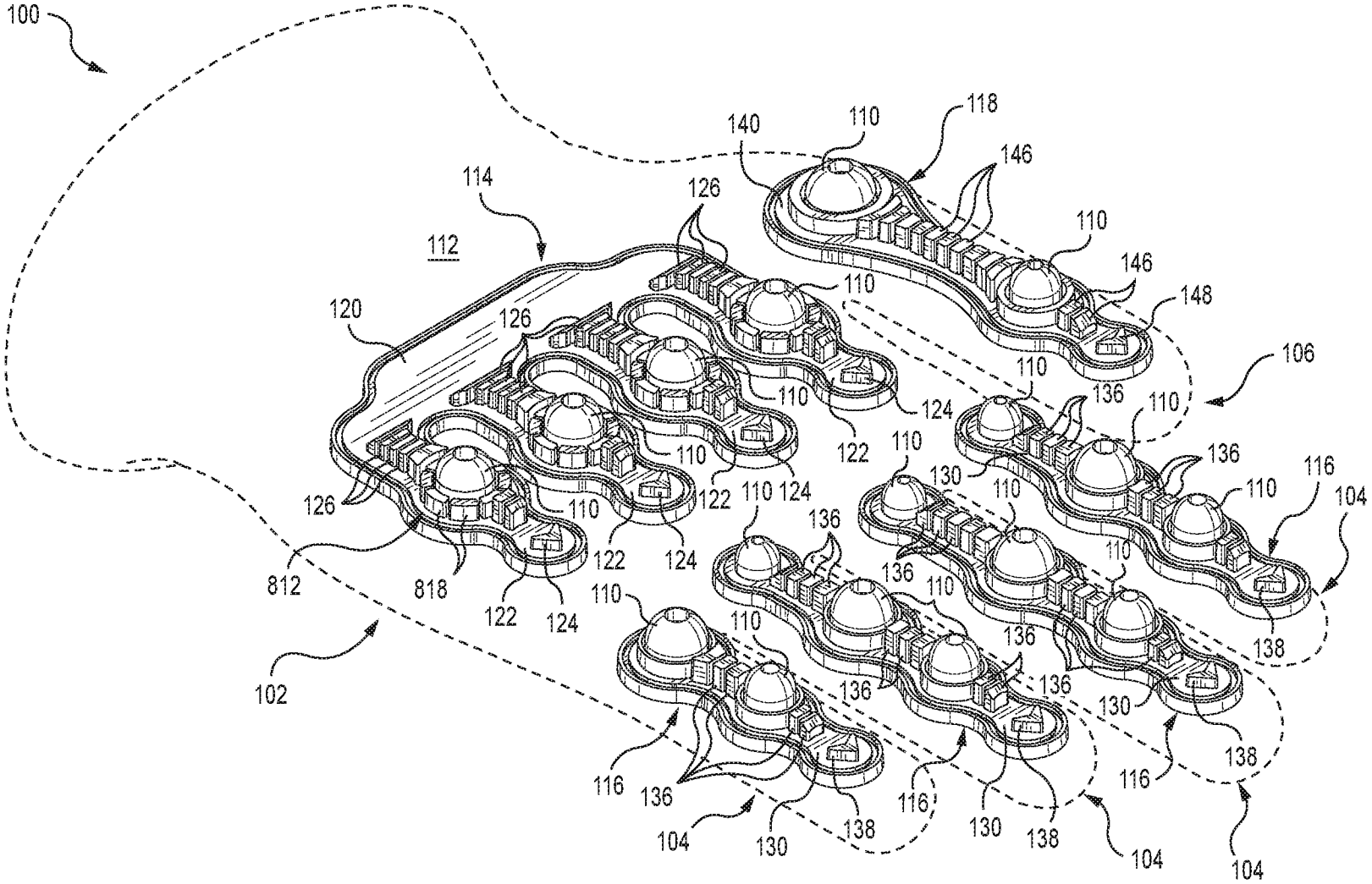
FIG. 11 is a dorsal perspective view of a third illustrative glove according to an aspect of the present disclosure.

While a right-handed glove has been shown for purposes of illustration, one of skill in the art will of course appreciate that the embodiments taught herein are equally applicable to a left-handed glove. Furthermore, the number and configuration of the impact dampers, projections and protrusions may vary, for example depending on the size of the glove. For example, FIG. 1 shows a "large" glove, FIG. 10 shows a "medium" glove 100 and FIG. 11 shows a "small" glove 100.

Illustrative embodiments have been described by way of example. It will be apparent to persons skilled in the art that a number of variations and modifications can be made without departing from the scope of the claims.

LIST OF REFERENCE NUMERALS

This list of reference numerals is provided solely for ease of reference and is not intended to be limiting.

100 Glove
102 Main Body Portion
104 Finger Portion
106 Thumb Portion
110 Impact Damper
112 Dorsal Side of Glove
114 Metacarpal Protector
116 Finger Protector
118 Thumb Protector
120 Metacarpal Linkage
122 Metacarpal Prong
124 Terminal Projection (on Metacarpal Prong)
126 Protrusion (on Metacarpal Prong)
130 Base of Finger Protector

132 Knuckle
134 Finger
136 Protrusion (on Finger Protector)
138 Terminal Projection (on Finger Protector)
140 Base of Thumb Protector
146 Protrusion (on Thumb Protector)
148 Terminal Projection (on Thumb Protector)
802 Convex Element
804 Zenith Cavity
806 Zenith
808 Arrow (Impact)
810 Arrow (Deformation)
812 Outwardly Deformable Wall
814 Spacer
816 Inner Surface of Outwardly Deformable Wall
818 Circumferentially Spaced Sectors of Outwardly Deformable Wall

What is claimed is:

1. A glove, comprising:

a plurality of impact dampers on a dorsal side of the glove, each of the plurality of impact dampers comprising:

a convex element formed from a resilient material, the convex element having a zenith cavity formed therein at its zenith and being otherwise solid, the convex element forming an annulus surrounding the zenith cavity;

an outwardly deformable wall formed from a resilient material, the outwardly deformable wall circumferentially surrounding and spaced from the convex element; and a finger protector formed from the resilient material, the finger protector comprising:

a longitudinally extending digitiform base, the digitiform base carrying the plurality of impact dampers and the outwardly deformable wall arranged in spaced-apart relation to one another and adapted to be aligned in registration with respective knuckles on a finger of a correspondingly sized human hand, wherein upon an impact on the convex element, the zenith cavity enables resilient outward deformation of the convex element and the resilient outward deformation dissipates energy from the impact and the convex element engages the outwardly deformable wall and resilient outward deformation of the outwardly deformable wall under urging from the convex element further dissipates the energy from the impact.

2. The glove of claim 1, wherein the outwardly deformable wall is divided into circumferentially spaced sectors.

3. The glove of claim 1, wherein the outwardly deformable wall is continuous.

4. The glove of claim 1, wherein the finger protector is monolithic.

5. The glove of claim 1, further comprising respective series of spaced-apart protrusions extending between the impact dampers.

6. The glove of claim 5, wherein the base extends beyond the plurality of impact dampers and includes a terminal projection.

7. The glove of claim 1, further comprising:

a metacarpal protector formed from the resilient material, the metacarpal protector comprising:

a metacarpal linkage; and a plurality of metacarpal prongs extending from the metacarpal linkage in side-by-side spaced apart maniform relation, each of the plurality of metacarpal prongs carrying at least one of the plurality of impact dampers.

8. The glove of claim 7, wherein the metacarpal protector is monolithic.

9. The glove of claim 7, wherein each metacarpal prong extends beyond the respective impact damper and includes a terminal projection.

10. The glove of claim 1, wherein the plurality of impact dampers are carried by a metacarpal protector and a plurality of finger protectors affixed to the glove.

11. The glove of claim 1, wherein the plurality of impact dampers are carried by a metacarpal protector, a plurality of finger protectors aid a thumb protector, all affixed to the glove.

* * * * *